US006722195B2

(12) United States Patent
Duke

(10) Patent No.: US 6,722,195 B2
(45) Date of Patent: Apr. 20, 2004

(54) SYSTEMS AND METHODS FOR PROJECTILE RECOVERY

(76) Inventor: Leslie P. Duke, Eight Ridgedale Dr., SE., Silver Creek, GA (US) 30173-2374

( * ) Notice: Subject to any disclaimer, the term of this patent is extended or adjusted under 35 U.S.C. 154(b) by 0 days.

(21) Appl. No.: 10/175,678

(22) Filed: Jun. 20, 2002

(65) Prior Publication Data

US 2003/0200800 A1 Oct. 30, 2003

Related U.S. Application Data

(63) Continuation-in-part of application No. 09/773,234, filed on Jan. 31, 2001.

(51) Int. Cl.[7] ..... F41J 1/12
(52) U.S. Cl. ..... 73/167; 273/410
(58) Field of Search ..... 73/167; 273/410, 273/404

(56) References Cited

U.S. PATENT DOCUMENTS 941,642 A * 11/1909 Maxim ..... 273/410
3,678,745 A 7/1972 Teng
3,762,709 A 10/1973 Roloff et al.
3,817,096 A 6/1974 Osofsky
4,038,869 A 8/1977 Curchack
4,076,246 A 2/1978 Meyer
4,121,959 A 10/1978 Meyer
4,235,444 A 11/1980 Meyer
4,300,389 A 11/1981 Tevelow
4,345,460 A 8/1982 Curchack et al.
4,433,843 A 2/1984 Bricco
4,456,264 A 6/1984 Detwiler
5,029,874 A 7/1991 Lamboy
5,778,725 A 7/1998 Kirschner et al.
5,988,647 A * 11/1999 Porter et al. ..... 273/410
5,998,647 A 12/1999 Seki et al.

* cited by examiner

*Primary Examiner*—Hezron Williams
*Assistant Examiner*—Rodney Frank
(74) *Attorney, Agent, or Firm*—Hinkle & O'Bradovich, LLC

(57) ABSTRACT

A method and apparatus for trapping projectiles so that the projectiles are not damaged is disclosed. An elongated trough is typically filled with alternating layers of a foam substance and a fibrous substance. Alternatively, the trough can be filled with just a foam or fibrous substance. A projectile launcher such as a gun is connected to the trough and a projectile is shot into the filling substance substantially parallel a longitudinal axis of the trough. The trough can be opened and the projectile can be recovered from the filling substance.

18 Claims, 7 Drawing Sheets

SYSTEMS AND METHODS FOR PROJECTILE RECOVERY

This application is a continuation-in-part of co-pending U.S. patent application Ser. No. 09/773,234, filed on Jan. 31, 2001, entitled "Systems And Methods For Projectile Recovery".

BACKGROUND OF THE INVENTION

I. Field of the Invention

The present invention relates generally to the field of ballistics, and more particularly to a method and apparatus for trapping bullets for ballistics testing.

II. Description of the Related Art

In many areas of law enforcement, ballistics and forensics, projectiles such as bullets are recovered from crime scenes and compared to a projectile fired from a gun that has been determined to have been used in a crime. Each barrel of a gun has a unique "fingerprint". This fingerprint is in the form of unique striations, typically called lands and grooves. A land is a raised area on internal part of a gun barrel. A groove is typically located between lands. A barrel land typically leaves a corresponding groove on a bullet fired from that barrel. A barrel groove typically leaves a corresponding land on the bullet fired from the barrel. It is often necessary to use projectile research apparatuses such as tanks of water and tanks of ballistics gelatin into which projectiles are fired for research. The goal is to recover the projectile in as near perfect condition to carry out the studies, to determine whether the bullet recovered from the crime scene matches the bullet from the gun determined to have been used in the crime. However, often times the projectile is damaged from the testing medium itself rendering the tests with inaccuracies. One problem is that the testing medium, for example, the water or the ballistics gelatin, is nearly incompressible. Therefore, when the projectile is shot into the medium, although the medium provides a path for the projectile, the projectile can be damaged from the medium due to the incompressibility of the medium. For example, a hollow tip bullet can often "mushroom", greatly distorting the lands and grooves from the barrel. A researcher often must fold the mushroomed portion of the bullet to interpret the marks. Furthermore, the bullet fired into the test medium can shatter, and the pieces must be recovered for testing and interpretation.

Therefore, markings left on the projectile, that is, the lands and grooved, from the barrel of the gun from which the projectile was shot are also deformed, flattened or otherwise distorted making it difficult to analyze the projectile and compare it with the crime scene projectile.

SUMMARY OF THE INVENTION

In accordance with the present invention and the contemplated problems which have and continue to exist in this field, the invention features a method and apparatus for recovering a projectile with minimal to no damage to the projectile, making subsequent testing and interpretation easier for the researcher. Often times, the bullet fired into the recovery apparatus is in pristine condition.

In general, the invention provides systems and methods that allow a projectile of interest to be fired into a projectile-capturing medium. The preservation of the bullet in a condition as close as possible to the condition of the bullet as it exits from the gun, with little to no damage from the projectile-capturing medium is the primary goal of the methods and systems. The medium is adapted to protect, preserve and secure the projectile for subsequent recovery and testing. The medium typically does not cause any damage to the projectile as with prior art systems. Sometimes, the medium can cause damage to the projectile, but it is typically minimal as compared to the prior art. The medium is typically comprised of alternating layers of a fibrous material and a foam material.

In operation, a projectile collects several fibers from the fibrous material as it travels though the fibrous layers. In typical embodiments, the fibrous material is natural cotton. Natural cotton includes features that maximize projectile capture but that do not damage the projectile. One feature of the cotton is the ability to release individual fibers to the projectile as the projectile passes through the fibrous layers. This collection of fibers on the projectile is a simple mechanical collection and the fibers can subsequently be manually removed with relative ease. Therefore, the natural cotton tends not to stick to projectile, not to burn from the heat of the projectile, or deform the projectile. If the fibers stuck to the projectile or other wised fused to the projectile, for example, from burning, the projectile would not be preserved for study and testing. While the fibers collect on the projectile, they provide enough friction to collect additional fibers on the fibers that have already collected on the projectile thereby causing a cotton "ball" to form around the projectile. It is this ball that protects the projectile from most damage in subsequent projectile-capturing medium layers. Therefore, the first layer in the alternating layers of cotton and foam is typically a cotton layer. Therefore, when the projectile covered in cotton fibers enters the next layer, a foam layer, the impact of the projectile covered in cotton fibers with the foam layer does not cause damage to the projectile. The projectile covered in cotton can then pass through subsequent layers of cotton, gather more fibers and pass through subsequent layers of foam which further decreases the velocity, momentum and kinetic energy of the projectile.

In general, in one aspect, the invention features a projectile recovery apparatus, including an elongated trough having a first end, a second end, a longitudinal axis and a substantially hollow interior, a projectile-capturing medium positioned in the entire interior of the trough and oriented about the longitudinal axis, and wherein one of the first and second ends is open, exposing the interior filled with the medium, and the other end is closed.

In one implementation, a first portion of the medium is a fibrous substance adapted to cover and protect the projectile and a second portion of the medium is a foam substance that is adapted to decrease the velocity of the projectile covered with the first portion, the first portion protecting the projectile from contact with the second portion.

In another implementation, the fibrous substance is natural cotton including fibers that are adapted to gather around the projectile to cover the projectile.

In another implementation, the fibrous substance and the foam substance are arranged in alternating layers.

In another implementation, the closed end is adapted to be removed to expose the interior of the trough, whereby a second elongated trough having additional projectile-capturing medium can be connected to the elongated trough to lengthen the apparatus.

In another implementation, the medium is a foam substance.

In another implementation, the foam substance is polyurethane.

In another implementation, the medium is a fibrous substance.

In another implementation, the fibrous substance is natural cotton having individual fibers that can be released to gather on the projectile.

In another implementation, the apparatus includes a series of openable hatches that can expose the filling material at various locations along the longitudinal axis.

In another aspect, the invention features a projectile recovery apparatus, including an elongated trough having an open end, a closed end, a longitudinal axis and a substantially hollow interior, a fibrous layer located at the open end and adapted to cover a projectile fired into the apparatus with individual fibers from the fibrous layer at least one foam layer located between the fibrous layer and the closed end and adapted to decrease the velocity of the projectile covered in the fibers from the fibrous layer that protects the projectile from contact with the foam layer, wherein the fibrous layer and the foam layer are configured along and about the longitudinal axis, and filling the interior.

In one implementation, the closed end be removed to expose the interior of the trough.

In another implementation, the apparatus includes a series of openable hatches that can expose the filling material at various locations along the longitudinal axis.

In another implementation, the apparatus includes at least one additional foam layer adapted to further decrease the velocity of the projectile and at least one additional fibrous layer having individual fibers that are adapted to further cover the projectile, wherein the foam layers and fibrous layers are alternately configured along the longitudinal axis.

In another implementation, the foam layers and the fibrous layers are substantially perpendicular to the longitudinal axis and substantially parallel with respect to each other and wherein each layer is in contact with the nearest layer.

In another implementation, the foam layers and the fibrous layers are positioned about the longitudinal axis at an orientation other than perpendicular to the longitudinal axis and substantially parallel with respect to each other.

In another implementation, the foam substance is polyurethane.

In another implementation, the fibrous substance is natural cotton.

In another aspect, the invention features a method of recovering a projectile, including providing a projectile recovery system, including an elongated trough having an open end, a closed end, a longitudinal axis and a substantially hollow interior and a projectile capturing medium positioned in the entire interior of the trough and oriented about the longitudinal axis, wherein a fibrous portion of the medium is adapted to cover and protect the projectile and a foam portion of the medium is adapted to decrease the velocity of the projectile covered with fibers from the fibrous portion, the fibrous material protecting the projectile from contact with the foam portion, shooting a projectile into the projectile recovery system substantially parallel to the longitudinal axis, wherein the projectile is aimed at the medium, the medium being alternately oriented in layers, wherein the first layer of the medium is a fibrous layer, wherein the projectile passes through the fibrous layer gathering fibers around the projectile, then into a subsequent foam layer, decreasing the projectile velocity, then into subsequent fibrous and foam layers, gathering more fibers from the fibrous layers and further decreasing the velocity through the foam layers until the projectile has stopped, searching through the medium of the projectile recovery system for the a fibrous ball that contains the projectile, and recovering the projectile from the fibrous ball.

In one implementation, the medium is a foam substance.

In another implementation, the medium is a fibrous substance.

In another implementation, the medium comprises alternating layers of fibrous material and foam material.

In another implementation, the method includes performing ballistics tests on the projectile.

In still another aspect, the invention features projectile recovery apparatus, including alternating layers of cotton and foam oriented about a longitudinal axis, the alternating layers of cotton and foam having an overall distance for a projectile to come to a full stop when the projectile is fired into the layers along the longitudinal axis.

In yet another aspect, the invention features a projectile recovery system, including an elongated trough adapted to receive a projectile, means for covering the projectile with a fibrous material and protecting the projectile, the means located within the trough and means for decreasing the velocity of the projectile, the means for covering the projectile protecting the projectile from the means for decreasing the velocity of the projectile, the means for decreasing the velocity of the projectile located within the trough.

One advantage of the apparatus is that a projectile to be studied can be shot into the projectile-capturing medium of the system and can be recovered with minimal to no damage to the projectile for ballistics and forensics research.

Another advantage is that the projectile-capturing medium minimally damages the projectile itself.

Another advantage is that the projectile retains markings, striations, lands and grooved representative of being shot from a unique barrel.

Other objects, advantages and capabilities of the invention will become apparent from the following description taken in conjunction with the accompanying drawings showing the preferred embodiment of the invention.

DETAILED DESCRIPTION OF THE INVENTION

Figure 1A:
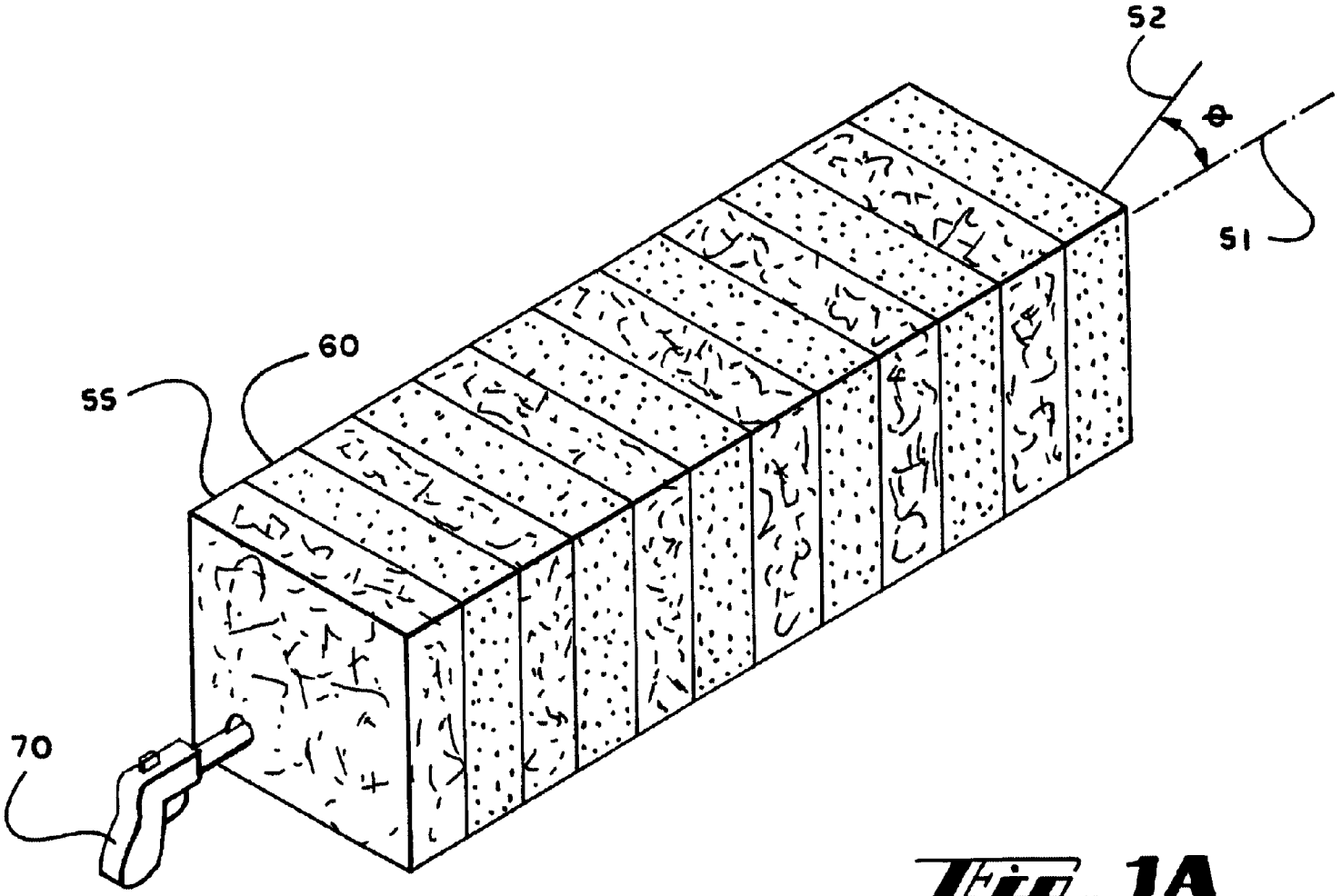
FIG. 1A illustrates a perspective view of an embodiment of a projectile recovery apparatus.

Referring to the drawings wherein like reference numerals designate corresponding parts throughout the several figures, reference is made first to FIG. 1A that illustrates a perspective view of an embodiment of a projectile recovery apparatus 50. The apparatus 50 typically includes several alternating layers of a fibrous material 55 and a foam material 60. The alternating layers perform as a projectile-capturing medium. Typically, the first layer is a fibrous layer 55 followed by the foam material 60 and so forth. The layers are generally perpendicular to a longitudinal axis 51. The fibrous material 55 can be used through the entire length of the apparatus 50. The foam material 60 can also be used throughout the entire length of the apparatus 50. However, the alternating layers of the fibrous material 55 and the foam material 60 have been determined to be an efficient configuration for projectile recovery with minimal to no damage to the projectile.

During operation of the apparatus 50, a projectile generally travels in a trajectory that is generally parallel to the longitudinal axis 51 of the apparatus 50, and perpendicular to the layers 55, 60. However, the projectile can also be fired into the apparatus 50 at angles other than parallel, such as along an axis 52 at an angle θ, with respect to the longitudinal axis 51. Alternatively, the layers 55, 60 could be rotated and oriented with respect to the longitudinal axis 150 at an angle, θ.

The layers 55, 60 are shown having a generally square shape. It is understood that several other shapes and formations can be used in the apparatus 50.

Figure 1B:
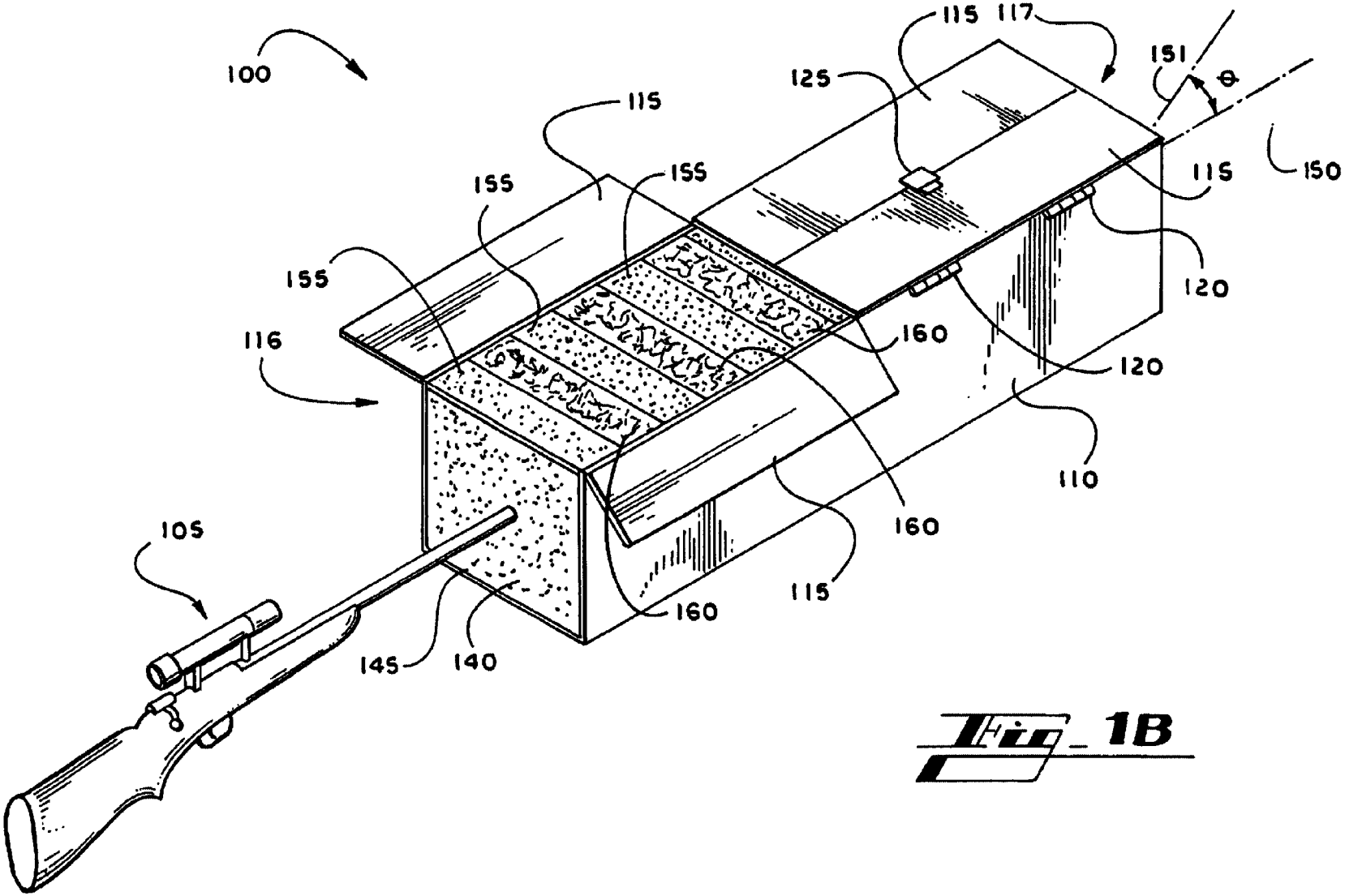
FIG. 1B illustrates a perspective view of another embodiment of a projectile recovery apparatus.

FIG. 1B illustrates a perspective view of an embodiment of a projectile recovery apparatus 100 having a gun 105 aimed into the interior of the apparatus 100. The apparatus 100 typically includes an elongated trough 110. The cross section of the trough 110 can be any variety of shapes. It is understood that several designs of the trough 110 can be made without departing from the scope of the apparatus 100. FIG. 1 illustrates the trough 110 having a square cross section. The trough can be any length. Typically, as described in more detail below, it is useful to have the length of the trough be on the order of eight feet. It is understood that any other length can be used. The length of the trough 110 varies depending on the power of the gun used to fire the projectile as well as other factors such as muzzle velocity, projectile size and the like. The length necessary in any given firing is determined by the length it takes for the projectile to come to a full stop in the projectile-capturing medium (described below). Furthermore, the ends of the trough 110 can be adapted to receive the ends of additional troughs so that a longer overall projectile recovery apparatus can be created by attaching additional troughs. In contrast, a single trough 110 can be made long enough to accommodate the longest distance it takes for a projectile to come top a stop.

The trough 110 can include a series of hatches 115 to expose the interior of the trough 110. The hatches 115 are connected to the trough by a mechanism such as a hinge 120. The hatches 115 can be securely closed by lock 125. The hatches can generally make up the entire top surface of the trough 110 to increase the area in which can be searched when recovering the projectile for study and testing. The trough 110 has a gun receiving end 116 that typically is open exposing the interior of the trough 110. It is useful to have the entire end open in order to have a greater area in which to fire the projectile. The opposite end 117 is typically a closed end. In an embodiment, the closed end can be adapted to be opened so that an additional trough can be attached to the trough 110.

The trough 110 is constructed of a sturdy material that can prevent a projectile from exiting a surface of the trough 110. In an embodiment, the trough is constructed entirely of a metallic substance. In other embodiments, the trough 110 can be adapted simply to hold the projectile-capturing medium in place. In simpler embodiments, a trough may not be necessary as described further below.

Although for most ballistics testing, the gun 105 is simply aimed into the trough 110, the trough 110 can also include a gun mount. The gun mount is used to support the gun 105 to provide a predictable trajectory of a bullet by preventing the gun from uncontrollably kicking back. The gun mount can have a variety of forms. For example, the gun mount can include two vertical support bars and a vertical adjustment cross bar. The vertical adjustment bar can be set and secured along the vertical support bars. A horizontal adjustment is used to support the barrel of the gun 105 as well as to set and secure the gun horizontally. The horizontal adjustment can also be pivoted about the cross bar providing an angle to the trajectory of the bullet with respect to a longitudinal axis 150 of the trough 110. In general, the user of the projectile recovery apparatus 100 does not adjust the angle of trajectory as described below with respect to operation of the apparatus 100.

The apparatus 100 also includes several alternating layers of a fibrous material 155 and a foam material 160. The alternating layers perform as a projectile-capturing medium. Typically, the first layer in the trough 110 is a fibrous layer 155 followed by the foam material 160 and so forth. The layers are generally perpendicular to the longitudinal axis 150 of the trough 110. The fibrous material 155 can be used through the entire length of the trough 110. The foamy material 160 can also be used throughout the entire length of the trough. However, the alternating layers of the fibrous material 155 and the foamy material 160 have been determined to be an efficient configuration for projectile recovery with minimal to no damage to the projectile.

During operation of the apparatus 100 a projectile generally travels in a trajectory that is generally parallel to the longitudinal axis 150 of the apparatus 100, and perpendicular to the layers 155, 160. However, the projectile can also be fired into the apparatus 100 at angles other than parallel, such as along an axis 151 at an angle θ, with respect to the longitudinal axis 150. Alternatively, the layers 155, 160 could be rotated and oriented with respect to the longitudinal axis 150 at an angle, θ.

Figure 2:
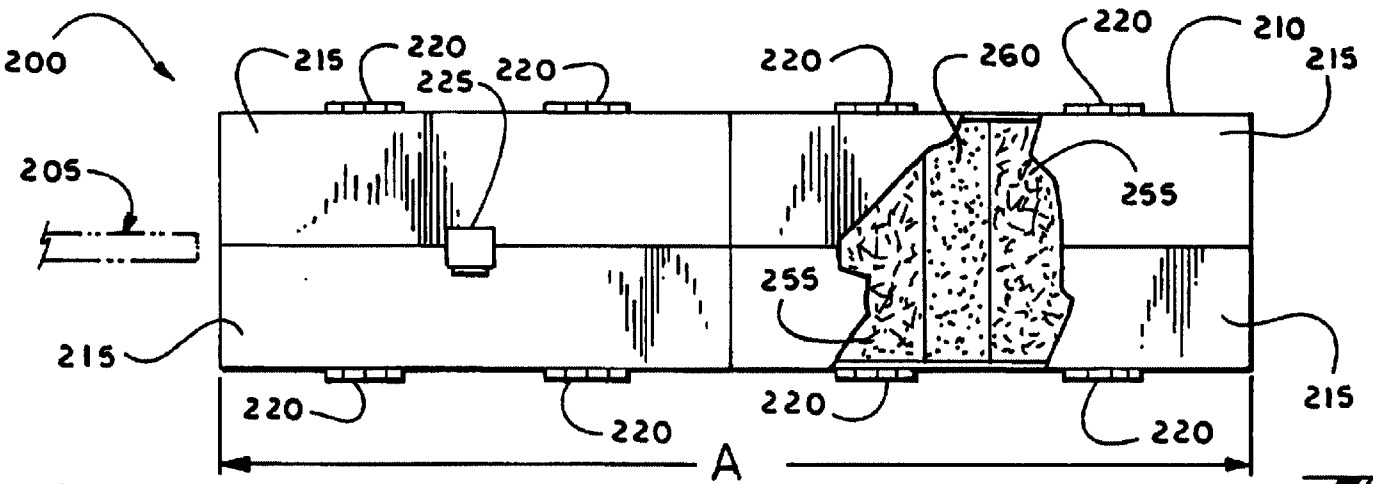
FIG. 2 illustrates a top view of an embodiment of a projectile recovery apparatus.

FIG. 2 illustrates a top view of an embodiment of a projectile recovery apparatus 200. A gun barrel 205 is shown aimed into the interior of the trough 210. The hatches 215 are shown in the closed position and securely fastened by lock 225. Each of the hatches 215 can be opened by having hinges 220. A broken view on two of the hatches 215 shows the alternating fibrous material 255 and foamy material 260 through which a projectile can travel in a substantially perpendicular trajectory with respect to the layers 255, 260. The trough is shown to be length A.

Figure 3:
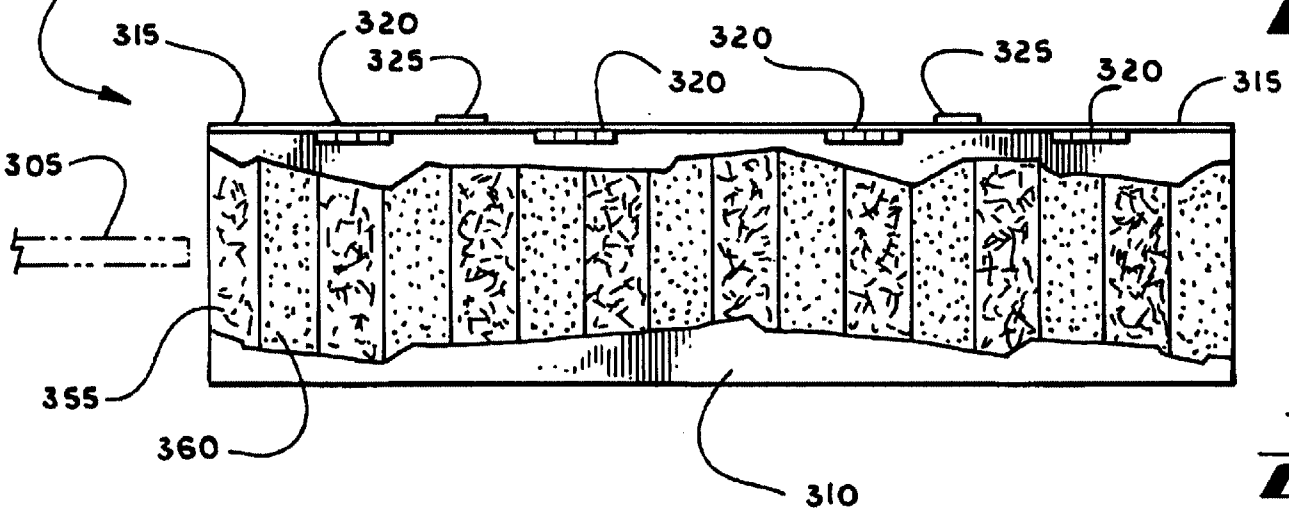
FIG. 3 illustrates a side view of an embodiment of a projectile recovery apparatus.

FIG. 3 illustrates a side view of an embodiment of a projectile recovery apparatus 300. A gun barrel 305 is shown aimed into the interior of the trough 310. The hatches 315 are shown in the closed position and securely fastened by lock 325. Each of the hatches 315 can be opened by having hinges 320. A broken view of the side of the trough 310 shows the alternating layers of fibrous material 355 and foamy material 360 through which a projectile can travel in a substantially perpendicular trajectory with respect to the layers 355, 360.

As described above, the materials used for the alternating layers in the projectile recovery apparatus have been described as fibrous and foam. In one embodiment, cotton can be used for the fibrous layer. In various experiments, it has been determined that for the fibrous material, natural cotton can be used for efficient projectile recovery. The cotton can be in the form of loose fluffed cotton, cotton balls and cotton batting. The term "batting" is understood as a term in the textile industry having a broad definition. Batting generally includes a wide range of materials that include the material used in furniture and upholstery. Batting can include natural cotton of various fiber lengths, and also by-products of the ginning process that can contain cotton linters, that is, the short fibers from the cotton seed. Furthermore, "cotton batting" can include a wide variety of textile waste products including polyester, nylon, rayon and other natural and synthetic products. Typically, "cotton batting" can include from 85% to 100% polyester. There are many different grades of cotton batting that can include several different fiber lengths. The grade of the cotton batting can be determined by the consistency of the fiber length contained in the batting. The best grade of the cotton batting can include the greatest consistency of two inch fibers. It has been experimentally determined that using the different types of cotton does not result in any noticeable change in recovered projectiles.

A variety of other fibrous materials can be used for the fibrous layers so long as the fibrous layer does not damage the projectile, or otherwise burn or stick to the projectile. Some fibrous materials can stick to the projectile when the projectile is hot. For example, although synthetic cotton can be used in an embodiment, the synthetic cotton doesn't offer as great resistance as natural cotton, taking too long for the projectile to stop. In addition, the fibers do not tend to gather as well on the projectile (as described below with respect to operation of the apparatus). Finally, the heat from the fired projectile causes the synthetic cotton to fuse to the projectile, making it difficult to remove from the projectile, thereby interfering with ballistics testing.

In one embodiment, the foam layers can be expanded polyurethane foam, which is typically a make-up of calcium carbonate and malomine. In various experiments, it has been determined that soft, medium or high density foam can be used for the foamy layers for efficient projectile recovery. It is understood that various other foam materials can be used for the foam layers. The expanded polyurethane foam has been experimentally determined to stop the projectile quickly with minimal to no damage to the projectile. The expanded polyurethane foam has the following typical characteristics:

| | |
|---|---|
| Light: | Density of 1 lb. per cubic foot with a compression of 20 to 25. |
| Medium: | Density of 2 lb. per cubic foot, with a compression of 28 to 33. |
| Heavy: | Density of 3 lb. per cubic foot, with a compression of 40 to 45. |

Typically the compression of foam is determined by placing ga 5 inch steel weight of approximately 20 lbs on foam using an arbitrary scale to measure.

It has been experimentally determined that medium density foam provides the optimum results. Soft foam does not stop the projectile as quickly as desired causing longer stopping distances. Heavy foam tends to cause "pitting" on the projectile as described further below. Other types of foam are also contemplated. Such foam material may also include rubber or latex foam.

Projectile Recovery Method

The projectile recovery apparatus described above with respect to FIGS. 1–3 can be used to fire a projectile into the interior of the trough through the alternating layers. The apparatus can typically be used for ballistics testing, leaving the projectile in a condition with minimal to no damage from the alternating layers, thereby preserving the unique striations (for example, the lands and grooves).

The preservation of the bullet in a condition as close as possible to the condition of the bullet as it exits from the gun, with little to no damage from the projectile-capturing medium is the primary goal of the methods and systems. The medium is adapted to protect, preserve and secure the projectile for subsequent recovery and testing. The medium typically does not cause any damage to the projectile. Sometimes, the medium can cause damage to the projectile, but it is typically minimal.

In operation, a projectile collects several fibers from the fibrous material as it travels though the fibrous layers. In typical embodiments, the fibrous material is natural cotton. Natural cotton includes features that maximize projectile capture but that do not damage the projectile. One feature of the cotton is the ability to release individual fibers to the projectile as the projectile passes through the fibrous layers. This collection of fibers on the projectile is a simple mechanical collection and the fibers can subsequently be manually removed with relative ease. Therefore, the natural cotton tends not to stick to projectile, not to burn from the heat of the projectile, or deform the projectile. If the fibers stuck to the projectile or other wised fused to the projectile, for example, from burning, the projectile would not be preserved for study and testing. While the fibers collect on the projectile, they provide enough friction to collect additional fibers on the fibers that have already collected on the projectile thereby causing a cotton "ball" to form around the projectile. It is this ball that protects the projectile from most damage in subsequent projectile-capturing medium layers. Therefore, the first layer in the alternating layers of cotton and foam is typically a cotton layer. Therefore, when the projectile covered in cotton fibers enters the next layer, a foam layer, the impact of the projectile covered in cotton fibers with the foam layer does not cause damage to the projectile. The projectile covered in cotton can then pass through subsequent layers of cotton, gather more fibers and pass through subsequent layers of foam which further decreases the velocity, momentum and kinetic energy of the projectile.

The travel of the projectile through the alternating layers is now described with respect to FIGS. 4A–4F which illustrate a projectile at various points in a projectile recovery apparatus 400.

Figure 4A:
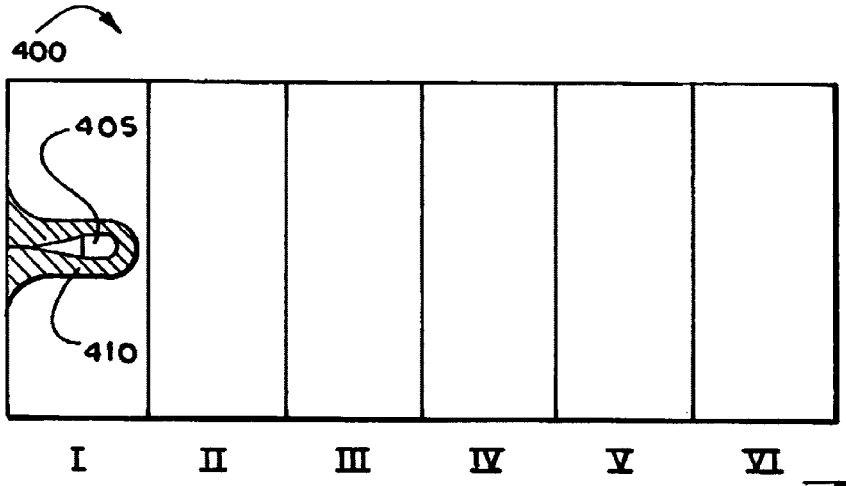
FIGS. 4A–4F illustrate a view of a projectile as it passes through an embodiment of a projectile recovery apparatus.

FIG. 4A illustrates a side view of a projectile recovery apparatus 400 at a point in which a projectile 405 is initially shot into the apparatus 400. The projectile 405 first enters the fibrous layer I. As the projectile moves through the layer I, the projectile 405 quickly gathers fibers from the fibrous layer around the projectile 405. As the fiber gathers it creates a first fiber covering 410, also called a cotton ball, around the projectile 405. It has been determined that minimal to no damage is caused to the projectile from the fibrous layer I, and the projectile is typically maintained in the same condition as it is when fired from the gun. By passing through the layer I the projectile also loses some of its kinetic energy, momentum and velocity due to friction from the surrounding layer I and increasing fiber covering 410.

Figure 4B:
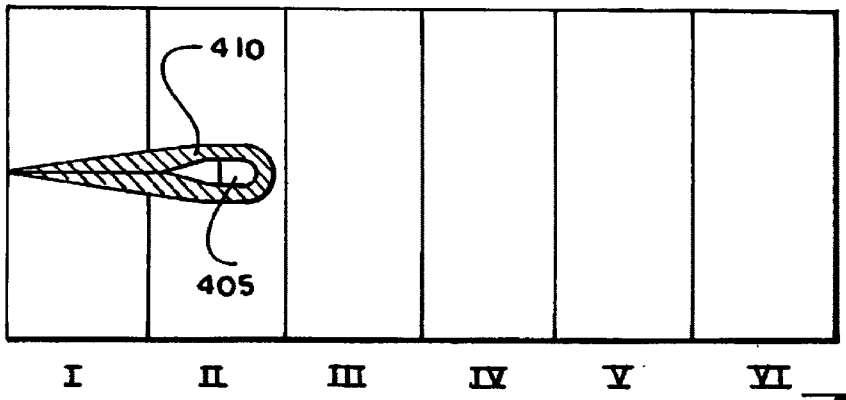

FIG. 4B illustrates a side view of the projectile apparatus of FIG. 4A at a point in which a projectile is traveling through the apparatus 400. After leaving layer I, the projectile then enters layer II, which is typically a foam layer. The projectile also travels with the fiber covering 410 as it travels through the foam layer II. Friction between the fibers covering 410 and the foam layer II removes more kinetic energy, momentum and velocity from the projectile 405. The fiber cover 410 also provides protection for the projectile 405 as it impacts with and travels through the foam layer II that is relatively rougher than the fibrous layer I.

Figure 4C:
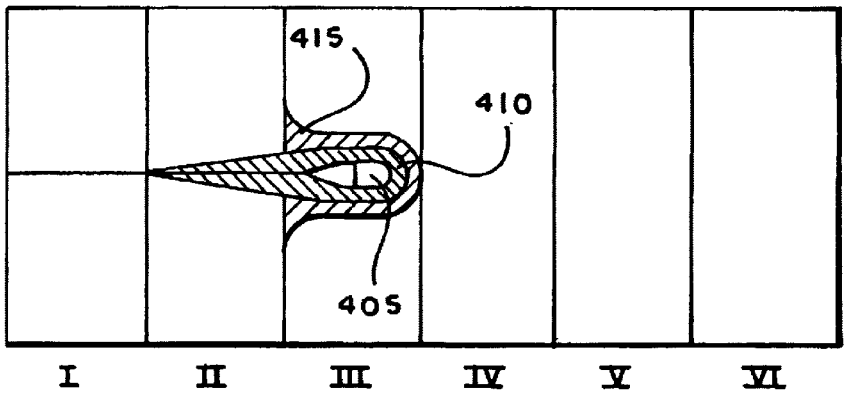

FIG. 4C illustrates a side view of the projectile apparatus of FIGS. 4A and 4B at a point in which a projectile is traveling through the apparatus 400. After leaving layer the projectile then enters layer II that is typically a fibrous layer. The projectile still includes the fiber covering 410. As the projectile 405 travels through the layer lII along with the cover 410, the cover 410 begins to become covered with another fiber layer 415. The friction of the cover 410 with the surrounding layer and the increasing cover 415 further decreases the kinetic energy, momentum and velocity of the projectile 405. The combined covers 410, 415 creates a larger protective cotton ball around the projectile 405.

Figure 4D:
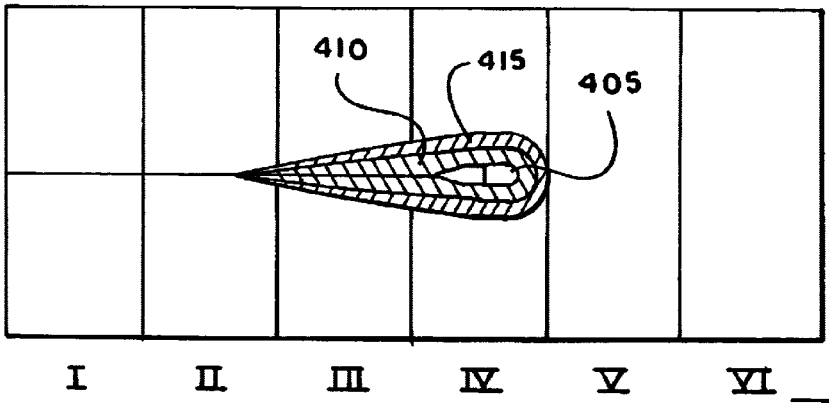

FIG. 4D illustrates a side view of the projectile apparatus of FIGS. 4A–4C at a point in which a projectile is traveling through the apparatus 400. After leaving layer III, the projectile 405 then enters layer IV, which is typically a foam layer. The projectile 405 also travels with the fiber coverings 410, 415 as it travels through the foam layer IV. Friction between the fiber covering 415 and the foam layer IV removes more kinetic energy momentum and velocity from the projectile 405. The covers 410, 415 also provide protection for the projectile 405 from the rough foam layer IV.

Figure 4E:
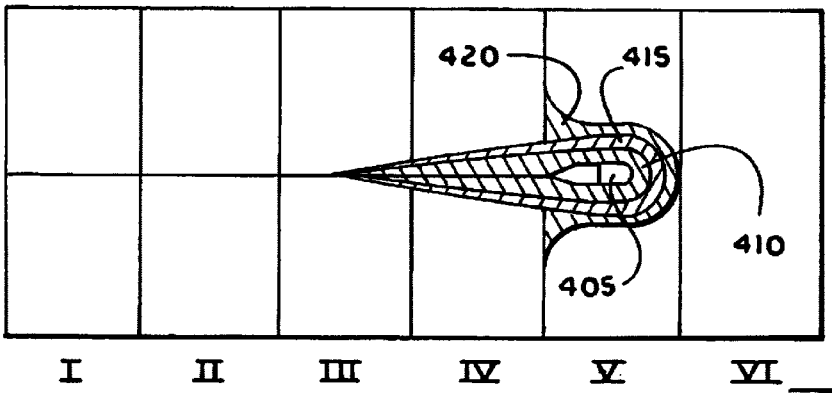

FIG. 4E illustrates a side view of the projectile apparatus of FIGS. 4A and 4D at a point in which a projectile is traveling through the apparatus 400. After leaving layer IV the projectile then enters layer V that is typically a fibrous layer. The projectile still includes the fiber covers 410, 415. As the projectile 405 travels through the layer V along with the covers 410, 415, the cover 415 begins to become covered with another fiber layer 420. The friction of the cover 415 with the surrounding layer V and the increasing cover 420 further decreases the kinetic energy, momentum and velocity of the projectile 405.

Figure 4F:
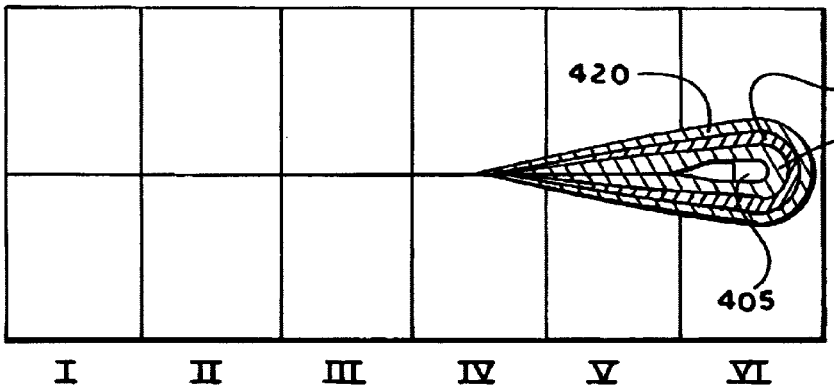

FIG. 4F illustrates a side view of the projectile apparatus of FIGS. 4A–4E at a point in which the projectile 405 is traveling through the apparatus 400. After leaving layer V, the projectile then enters layer VI, which is typically a foam layer. The projectile 405 also travels with the fiber coverings 410, 415, 420 as it travels through the foamy layer VI. Friction between the fiber covering 420 and the foam layer VI removes more kinetic energy momentum and velocity from the projectile 405. The covers 410, 415, 420 also provide protection for the projectile 405 from the rough foam layer VI. In an implementation, depending on the muzzle velocity of the projectile, the projectile 405 finally loses all of its velocity and ceases moving in layer VI. When the projectile 405 comes to a stop, the fiber covers 410, 415, 420 typically leave a tail portion as shown in layers IV, V. It is understood that fewer or more layers can be necessary depending on the length the projectile 405 needs to come to a complete stop.

Figure 5:
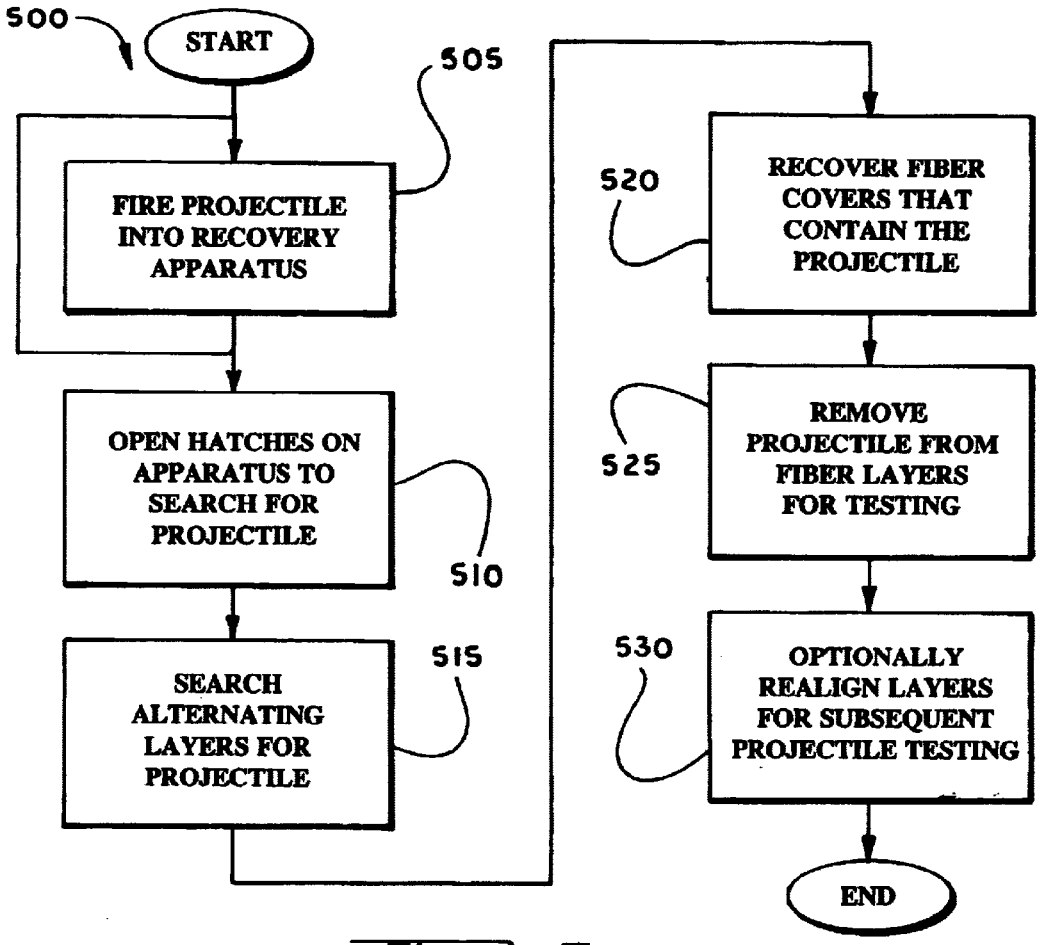
FIG. 5 illustrates a flow chart of an implementation of a method 500 of projectile recovery.

FIG. 5 illustrates a flow chart of an implementation of a method 500 of projectile recovery using the apparatus described above. The user of the apparatus chooses a gun to be tested. The gun is aimed into the apparatus as described above. The projectile is then fired 505 into the recovery apparatus. This process of firing a projectile apparatus can be repeated as many times as desired. Typically, the user repositions the gun so that the subsequent projectile does not travel the same trajectory as the previous projectile. It is desirable not to fire too many projectiles into the apparatus without changing the layers. Too many projectiles fired into the layers typically causes the foam to weaken which results in greater stopping distances. New foam offers more resistance to the projectile and fiber covers resulting in substantially short stopping times and shorter stopping distances.

Once the desired number of projectiles are fired into the apparatus, the user opens 510 the hinges of the apparatus to search for the projectile. Typically, the user searches 515 the alternating layers and separates the layers to search for a fiber trail caused by the accumulation of fiber covers as discussed above. The user typically discovers an accumulated ball of fiber. The user recovers 520 the fiber covers containing the projectile. The user then removes 525 the projectile from the fibers layers for subsequent testing.

The user can then optionally realign 530 the layers to prepare the apparatus to receive subsequent projectiles. The user may have to replace the foam and cotton as described above.

When the projectile is recovered it is typically in virtually the same condition as it was before it was fired. The following tables illustrate empirical data on several different types of projectiles fired into the apparatus and the corresponding layer characteristics:

TABLE 1

| Cotton/Foam Layering | Caliber | Stopping Distance | Projectile Condition |
|---|---|---|---|
| 1" 1" | 7.62 × 39 | 11' 5" | Perfect |
| 1" 1" | 45 ACP | 2' 8" | Perfect |
| 2" 2" | 7.62 × 39 | 12' 0" | Some Burning |
| 2" 2" | 45 ACP | 3' 6" | Perfect |
| 3" 3" | 7.62 × 39 | 13' 3" | Some Burning |
| 3" 3" | 45 ACP | 3' 9" | Perfect |
| 4" 4" | 7.62 × 39 | 11' 11" | Perfect |
| 4" 4" | 45 ACP | 4' 6" | Perfect |
| 4" 4" | 40 | 4' 6" | Perfect |
| 5" 5" | 7.62 × 39 | 10' 6" | Perfect |
| 5" 5" | 45 ACP | 2' 10" | Perfect |
| 6" 6" | 7.62 × 39 | 11' 0" | Perfect |
| 6" 6" | 45 ACP | 3' 3" | Perfect |
| 7" 7" | 7.62 × 39 | 10' 10" | Perfect |
| 7" 7" | 45 ACP | 3' 0" | Perfect |
| 8" 8" | 7.62 × 39 | 10' 9" | Perfect |
| 8" 8" | 45 ACP | 2' 10" | Perfect |
| 8" 8" | 40 | 4' 0" | Perfect |
| 9" 9" | 7.62 × 39 | 12' 6" | Perfect |
| 9" 9" | 45 ACP | 4' 0" | Perfect |
| 10" 10" | 7.62 × 39 | 12' 5" | Some Burning |
| 10" 10" | 45 ACP | 2' 2" | Perfect |
| 11" 11" | 7.62 × 39 | 10' 5" | Some Burning |
| 11" 11" | 45 ACP | 2' 2" | Perfect |
| 12" 12" | 7.62 × 39 | 10' 5" | Some Burning |
| 12" 12" | 45 ACP | 3' 5" | Perfect |
| 12" 12" | 40 | 3' 9" | Perfect |

TABLE 2

| Caliber | Weight | Muzzle Velocity (FPS) | Muzzle Energy (Foot Pounds) | Stopping Distance |
|---|---|---|---|---|
| 22 Cal REM HP | 36 Grains | 1410 | 165 | 3' 10" |
| 7 mm REM MAG | 150 Grains | 310 | 3221 | 17' 7" |
| 223 SS109 (AP) | 62 Grains | 3025 | 1260 | 11' 10" |
| 40 S&W | 180 Grains | 1150 | 499 | 4' 6" |
| 30 –30 WIN | 150 Grains | 2390 | 1900 | 10' 4" |

TABLE 2-continued

| Caliber | Weight | Muzzle Velocity (FPS) | Muzzle Energy (Foot Pounds) | Stopping Distance |
|---|---|---|---|---|
| 45 CAL HYDRA SHOCK | 230 Grains | 850 | 370 | 4' 0" |
| 38 Special | 158 Grains | 760 | 200 | 3' 7" |
| 12 Gauge Slug | 1 Ounce | 1525 | 2260 | 7' 0" |
| 8 mm (AP) | 154 Grains | 2880 | 2837 | 13' 7" |
| 7.62 × 39 | 123 Grains | 2365 | 1552 | 11' 11" |
| 9 mm Starfire | 124 Grains | 1175 | 364 | 3' 4" |

The data in Table 2 are results from tests in the projectile recovery apparatus using alternating layers of cotton fiber of 4" and medium density foam layers of 4".

A number of embodiments have been described. Nevertheless, it will be understood that various modifications may be made without departing from the spirit and scope of the invention. Several examples are now illustrated.

As mentioned above all foam or all fiber layers can be used in the apparatus. In this embodiment, the bullet tends to be more difficult to locate. Using all foam does stop the projectile quickly but tends to cause pitting on the projectile. Using all fiber layers also stops the projectile quicker but does not always leave powder residue. In addition the projectile is difficult to find in all fiber layers. Finally the nose of the projectile tends to deform with all fiber layers.

The following data are results for various tests of projectiles using all fiber or all foam layers:

TABLE 3

| Caliber | Material | Stopping Distance | Projectile Condition |
|---|---|---|---|
| 7.62 × 39 | All Foam | 15' 7" | Poor (Pitted) |
| | All Fiber | 7' 8" | Poor (Burnt) |
| 45 ACP Cast Lead | All Foam | 1' 6" | Good |
| | All Fiber | 1' 10" | Good |
| 45 ACP 230 gr HP | All Foam | 7' 2" | Fair (Nose Deformed) |
| | All Fiber | 2' 2" | Good |
| 7 mm REM MAG. | All Foam | 20' 0" | Good |
| | All Fiber | 13' 7" | Fair |
| 8 mm | All Foam | 17' 4" | Good |
| | All Fiber | 10' 8" | Good |
| 40 S & W | All Foam | 11' 5" | Fair (Slight Pitting) |
| | All Fiber | 1' 11" | Good |

The following figures illustrate specific results comparing projectiles fired into a prior art water tank and fired into a projectile recovery apparatus as described in the embodiments above.

Figure 6:
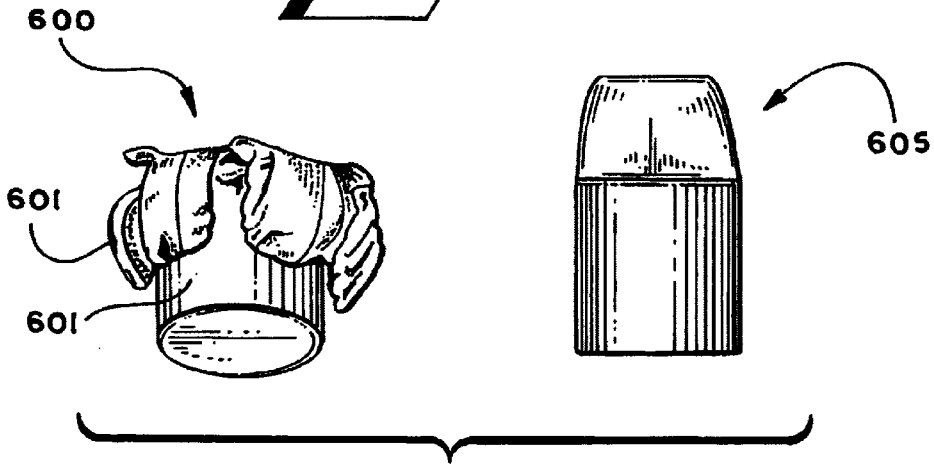
FIG. 6 illustrates a 0.40 caliber projectile fired into a prior art water tank and a projectile fired into an embodiment of a projectile recovery apparatus.

FIG. 6 illustrates a 0.40 caliber projectile 600 fired into a prior art water tank and a 0.40 caliber projectile 605 fired into an embodiment of a projectile recovery apparatus. The projectile 600 fired into the water tank typically includes several shards of mushroomed metal 601 that the researcher must fold back into place in order to study the projectile 600. The projectile 605 fired into an embodiment of a projectile recovery apparatus as described above is in near pristine condition, that is, almost identical to how it is when fired from the gun, allowing ballistics research to be performed on the projectile 605.

Figure 7:
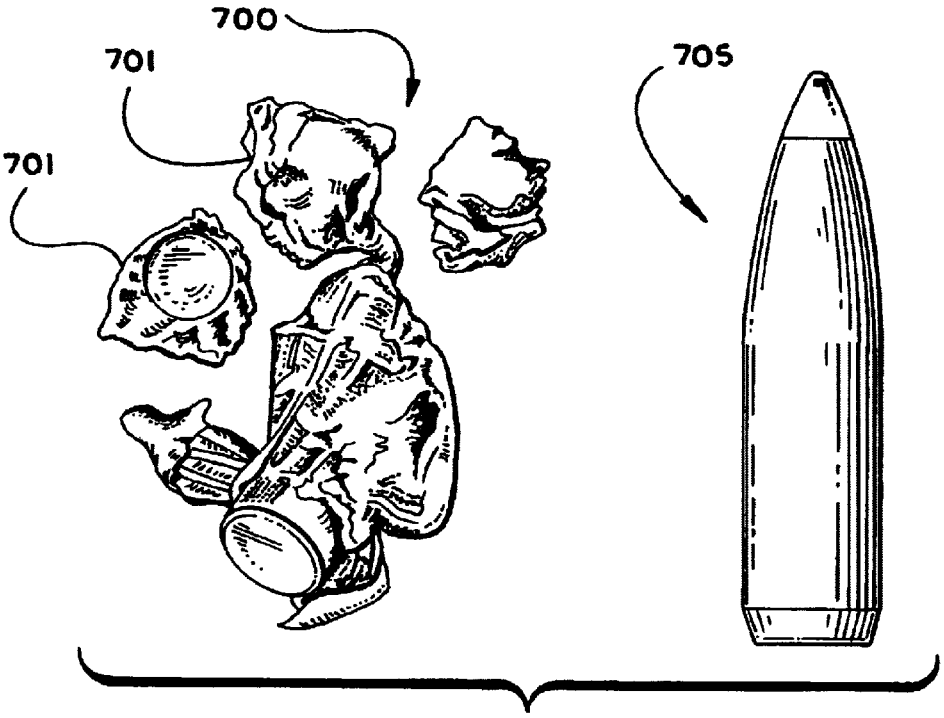
FIG. 7 illustrates a 0.308 ballistic tip projectile fired into a prior art water tank and a projectile fired into an embodiment of a projectile recovery apparatus.

FIG. 7 illustrates a 0.308 ballistic tip projectile fired into a prior art water tank and a 0.308 ballistic tip projectile fired into an embodiment of a projectile recovery apparatus. The projectile 700 fired into the water tank typically shatters into several pieces 701. The researcher must therefore work with the several shards 701 in order to study the projectile 700. The projectile 705 fired into an embodiment of a projectile recovery apparatus as described above is in near pristine condition, that is, almost identical to how it is when fired from the gun, allowing ballistics research to be performed on the projectile 705.

Figure 8:
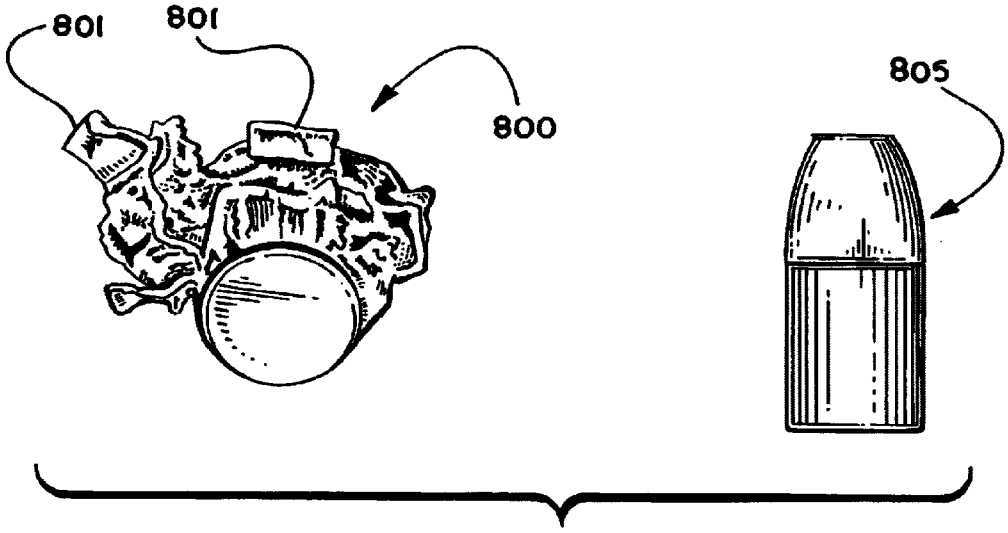
FIG. 8 illustrates a 0.40 caliber hollow point projectile fired into a prior art water tank and a projectile fired into an embodiment of a projectile recovery apparatus.

FIG. 8 illustrates a 0.40 caliber hollow point projectile 800 fired into a prior art water tank and a 0.40 caliber hollow point projectile 805 fired into an embodiment of a projectile recovery apparatus. The projectile 600 fired into the water tank typically includes several shards of mushroomed metal 801 that the researcher must fold back into place in order to study the projectile 800. The projectile 805 fired into an embodiment of a projectile recovery apparatus as described above is in near pristine condition, that is, almost identical to how it is when fired from the gun, allowing ballistics research to be performed on the projectile 805.

The embodiments described above have typically included projectiles in the form of bullets. In another embodiment, the projectile recovery apparatus can be used to test arrows BBs and other types of projectiles. It is understood that there is no limit to the types of projectiles that can be used in the apparatus.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A projectile recovery kit, comprising:

an elongated trough having a first end, a second end, a longitudinal axis and a hollow interior;

a projectile-capturing medium positioned in the interior of the trough and oriented about the longitudinal axis, a first portion of the medium being a fibrous substance adapted to transform a projectile fired into the medium into a fibrous ball that protects the projectile from remaining portions of the projectile-capturing medium and a second portion of the medium being a foam substance adapted to decrease the velocity of the fibrous ball containing the projectile as the fibrous ball travels through the medium, whereby the projectile can be subsequently removed from the fibrous ball and be in the same condition or near same condition as it was before it entered into the medium, and wherein one of the first and second ends is open, exposing the interior filled with the medium, and the other end is closed.

2. The kit as claimed in claim 1, wherein the fibrous substance is cotton including fibers that are adapted to gather around the projectile to cover the projectile, thereby transforming it into the fibrous ball.

3. The kit as claimed in claim 1, wherein the fibrous substance and the foam substance are arranged in alternating layers.

4. The kit as claimed in claim 1, wherein the foam substance is polyurethane.

5. The kit as claimed in claim 1 further comprising a series of openable hatches that can expose the projectile-capturing medium at various locations along the longitudinal axis.

6. A projectile recovery apparatus, comprising:

an elongated trough having a first end, a second end, a longitudinal axis and a generally hollow interior;

a projectile capturing medium positioned in the interior of the trough and oriented about the longitudinal axis, and wherein one of the first and second ends is open. exposing the interior filled with the medium, and the other end is closed, wherein the closed end is adapted to be removed to expose the interior of the trough, whereby a second elongated trough having an additional projectile-capturing medium can be connected to the elongated trough to lengthen the apparatus.

7. A projectile recovery apparatus, comprising:

an elongated trough having an open end, a closed end, a longitudinal axis and a hollow interior;

a fibrous layer located at the open end;

at least one foam layer located between the fibrous layer and the closed end, wherein the fibrous layer and the foam layer are configured along and about the longitudinal axis, and filling the interior; and a projectile previously having a velocity from being fired and positioned within the interior, the projectile being covered in a fibrous ball from having passed through the fibrous layer and subsequently having the velocity decreased to bring it to its position within the interior after passing through the foam layer, the projectile being in a condition retaining its characteristic features that it obtained from an instrument from which the projectile was fired thus being in the same condition or near same condition as it was before it entered into the medium.

8. The apparatus as claimed in claim 7, wherein the closed end can be removed to expose the interior of the trough.

9. The apparatus as claimed in claim 7 further comprising a series of openable hatches that can expose the fibrous and foam layers at various locations along the longitudinal axis.

10. The apparatus as claimed in claim 7 further comprising:

at least one additional foam layer adapted to further decrease the velocity of the projectile; and at least one additional fibrous layer to add additional fibers to the fibrous ball, wherein the foam layers and the fibrous layers are alternately configured along the longitudinal axis.

11. The apparatus as claimed in claim 10, wherein the foam layers and the fibrous layers are generally perpendicular to the longitudinal axis and generally parallel with respect to each other and wherein each layer is in contact with the nearest layer.

12. The apparatus as claimed in claim 10, wherein the foam layers and the fibrous layers are positioned about the longitudinal axis at an orientation other than perpendicular to the longitudinal axis and generally parallel with respect to each other.

13. The apparatus as claimed in claim 7, wherein the foam layer is polyurethane.

14. The apparatus as claimed in claim 7, wherein the fibrous layer is cotton.

15. A method of recovering a projectile, comprising:

providing a projectile recovery system, including:

an elongated trough having an open end, a closed end, a longitudinal axis and a generally hollow interior; and a projectile capturing medium positioned in the interior of the trough and oriented about the longitudinal axis, wherein a fibrous portion of the medium is adapted to cover and protect the projectile and a foam portion of the medium is adapted to decrease the velocity of the projectile, which is transformed into a fibrous ball after having passed through the fibrous portion, the fibrous ball protecting the projectile from contact with the foam portion;

shooting a projectile into the projectile recovery system generally parallel to the longitudinal axis, wherein the projectile is aimed at the medium, the medium being alternately oriented in layers, wherein the first layer of the medium is a fibrous layer, wherein the projectile passes through the fibrous layer gathering fibers around the projectile that is transformed into the fibrous ball, then into a subsequent foam layer, decreasing the projectile velocity, then into subsequent fibrous and foam layers, gathering more fibers on the fibrous ball from the fibrous layers and further decreasing the velocity through the foam layers until the projectile has stopped;

searching though the medium of the projectile recovery system for the fibrous ball that contains the projectile; and recovering the projectile from the fibrous ball, wherein the projectile is in a same or near same condition as it was before it entered the medium.

16. The method as claimed in claim 15, further comprising performing ballistics tests on the projectile.

17. A projectile recovery apparatus, comprising:

alternating layers of fibrous material and foam oriented about a longitudinal axis, the alternating layers of fibrous material and foam having an overall distance for a projectile to come to a full stop when the projectile is fired into the layers along the longitudinal axis, the projectile being transformed into a fibrous ball and remaining in a condition having features of a instrument from which it was fired.

18. A projectile recovery system, comprising:

an elongated trough adapted to receive a projectile;

means for transforming the projectile into a fibrous ball and protecting the projectile within the fibrous ball and keeping the projectile in a consistent condition as it was after it was fired and before it entered the trough, as it travels through the trough, the means located within the trough; and means for deceasing the velocity of the fibrous ball containing the projectile, the means for transforming the projectile protecting the projectile from the means for decreasing the velocity of the projectile, the means for decreasing the velocity of the projectile located within the trough.

* * * * *